US007066248B2

(12) United States Patent
Howell

(10) Patent No.: US 7,066,248 B2
(45) Date of Patent: Jun. 27, 2006

(54) BOTTOM DISCHARGE SEAL SECTION

(75) Inventor: Alan Howell, Oklahoma City, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 235 days.

(21) Appl. No.: 10/459,193

(22) Filed: Jun. 11, 2003

(65) Prior Publication Data

US 2004/0251019 A1 Dec. 16, 2004

(51) Int. Cl.
*E21B 43/00* (2006.01)

(52) U.S. Cl. ..... 166/105.5; 166/105; 166/106; 166/66.4; 417/414; 310/87

(58) Field of Classification Search ..... 166/105.5, 166/105, 66.4, 106; 310/87; 417/414
See application file for complete search history.

(56) References Cited

U.S. PATENT DOCUMENTS

| | | | | |
|---|---|---|---|---|
| 1,778,787 | A | 10/1930 | Arutunoff | |
| 2,236,887 | A * | 4/1941 | Arutunoff | 417/414 |
| 2,455,022 | A * | 11/1948 | Schmidt | 417/99 |
| 3,404,924 | A * | 10/1968 | Choate | 384/149 |
| 3,502,919 | A | 3/1970 | Boyd et al. | |
| 3,571,636 | A | 3/1971 | Carle et al. | |
| 4,421,999 | A | 12/1983 | Beavers et al. | |
| 4,537,257 | A | 8/1985 | Todd | |
| 4,667,737 | A | 5/1987 | Shaw et al. | |
| 4,992,689 | A * | 2/1991 | Bookout | 310/87 |
| 5,367,214 | A | 11/1994 | Turner, Jr. | |
| 6,033,567 | A | 3/2000 | Lee et al. | |
| 6,092,600 | A | 7/2000 | McKinzie et al. | |
| 6,167,965 | B1 | 1/2001 | Bearden et al. | |
| 6,201,327 | B1 | 3/2001 | Rivas | |
| 6,206,093 | B1 | 3/2001 | Lee et al. | |
| 6,268,672 | B1 * | 7/2001 | Straub et al. | 310/87 |
| 6,307,290 | B1 | 10/2001 | Scarsdale | |
| 6,325,143 | B1 | 12/2001 | Scarsdale | |

* cited by examiner

*Primary Examiner*—Kenneth Thompson
(74) *Attorney, Agent, or Firm*—Crowe & Dunlevy, P.C.

(57) ABSTRACT

Disclosed is an electric submersible pumping system for use in wellbore. The electric submersible pumping system includes a motor assembly, a pump assembly and a seal section disposed in the wellbore. The pump assembly is below the motor and is driven by the motor. The seal section is between the motor assembly and the pump assembly, and protects the motor assembly from thrust generated in the pump assembly. The seal section includes a shaft that transmits torque from the motor assembly to the pump assembly. A labyrinth chamber in the seal section restricts the flow of wellbore fluids. The seal section can also include a mechanical seal, a thrust bearing, a bag type chamber, an abrasion resistant bearing, and a motor electrical termination.

9 Claims, 4 Drawing Sheets

BOTTOM DISCHARGE SEAL SECTION

FIELD OF THE INVENTION

This invention relates generally to the field of submersible pumping systems, and more particularly, but not by way of limitation, to a seal section for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Each of the components in a submersible pumping system must be engineered to withstand the inhospitable downhole environment.

Components commonly referred to as "seal sections" or "motor protectors" protect the electric motors and are typically positioned above the motor. These components provide several functions, such as transmitting torque between the motor and pump, restricting the flow of wellbore fluids into the motor, protecting the motor from axial thrust imparted by the pump, and accommodating the expansion and contraction of motor lubricant.

By way of illustration, FIG. 1 shows a prior art submersible pumping system 200 disposed in a wellbore 202, and includes an electric motor 204, a pump 206, and a seal section 208. The submersible pumping system 200 is attached to production tubing 210, which provides a conduit for producing fluids to the surface.

Torque is generated in the motor 204 and transmitted to the pump 206 by a shaft in the seal section 208. Since the shaft is a potential leak path by which corrosive wellbore fluids can reach the motor 204, the seal section 208 is designed to limit the flow of wellbore fluids along the shaft.

The seal section 208 also protects the motor 204 from axial thrust and shock created by the pump 206. The pump 206 pulls in wellbore fluids and propels the fluids up the production tubing 210, creating axial thrust that can damage the motor 204. The seal section 208 absorbs some of this thrust, providing a barrier between the motor 204 and the pump 206.

Heat in the wellbore and heat generated by the motor 204 during operation cause the lubricating oil to expand in the oil filled motor 204. Excessive expansion of the lubricating oil can cause damage to the motor if the lubricating oil is not allowed to escape. As a safeguard, the seal section 208 provides a means by which the oil can escape, preventing the accumulation of excessive pressure inside the motor 204.

Similarly, the seal section 208 also provides a means for accommodating contraction of the lubricating oil during cooling. As the lubricating oil contracts, wellbore fluid is drawn into the seal section 208 to maintain the appropriate pressure gradient between the motor 204, the seal section 208 and the wellbore. The seal section 208 is also designed to segregate the lubricating oil and the wellbore fluid to avoid contamination of lubricating oil in the motor 204.

Alternate configurations of the pump and motor may also be desirable in a wellbore tool string. For example, in some wellbore operations, fluids are forced down the well from one zone to another. In these operations, it is often desirable to place the pump below the motor at the bottom of the tool string. This configuration increases the risk that wellbore fluids will migrate upward from the pump into the motor.

The motor may also be subjected to increased axial thrust from the pump located at the bottom of the tool string. There is therefore a need for protecting the motor from axial thrust and wellbore fluid contamination in configurations where the pump is located below the motor. It is to these and other deficiencies in the prior art that the present invention is directed.

SUMMARY OF THE INVENTION

Preferred embodiments of the present invention provide an electric submersible pumping system for use in wellbore fluids. The electric submersible pumping system includes a motor assembly, an upper seal section, a pump assembly and a lower seal section. The upper seal section is above the motor assembly and accommodates oil expansion in the motor assembly. The pump assembly is below and driven by the motor assembly. The lower seal section is between the motor assembly and the pump assembly. The lower seal section includes a shaft that transmits torque from the motor assembly to the pump assembly and a labyrinth chamber that restricts the flow of the wellbore fluids that migrate from the pump assembly to the motor assembly.

DETAILED DESCRIPTION OF THE PREFERRED EMBODIMENT

Figure 1:
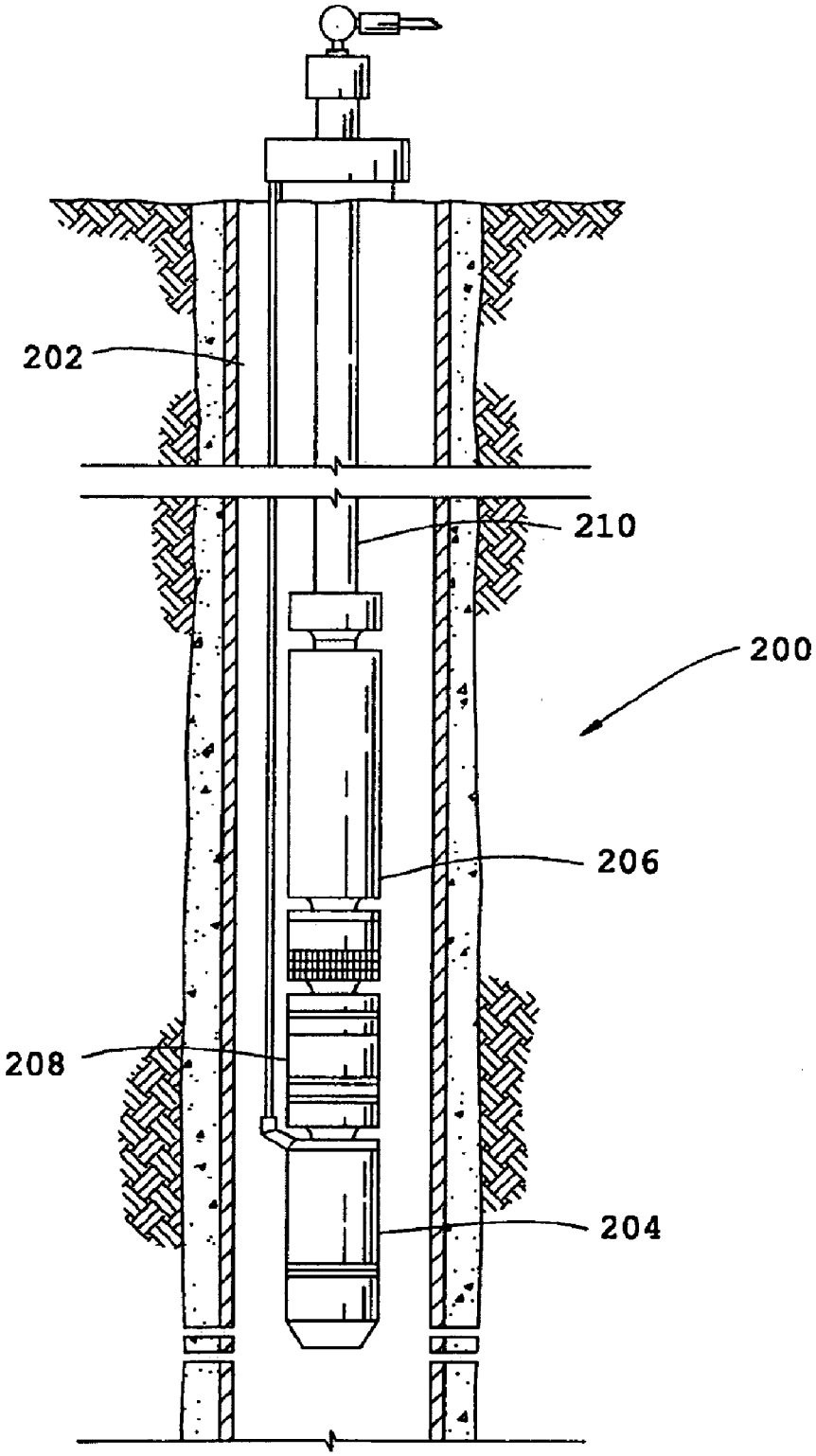
PRIOR ART FIG.1
FIG. 1 is an elevational view of a prior art electric submersible pumping system disposed in a wellbore.
Figure 2:
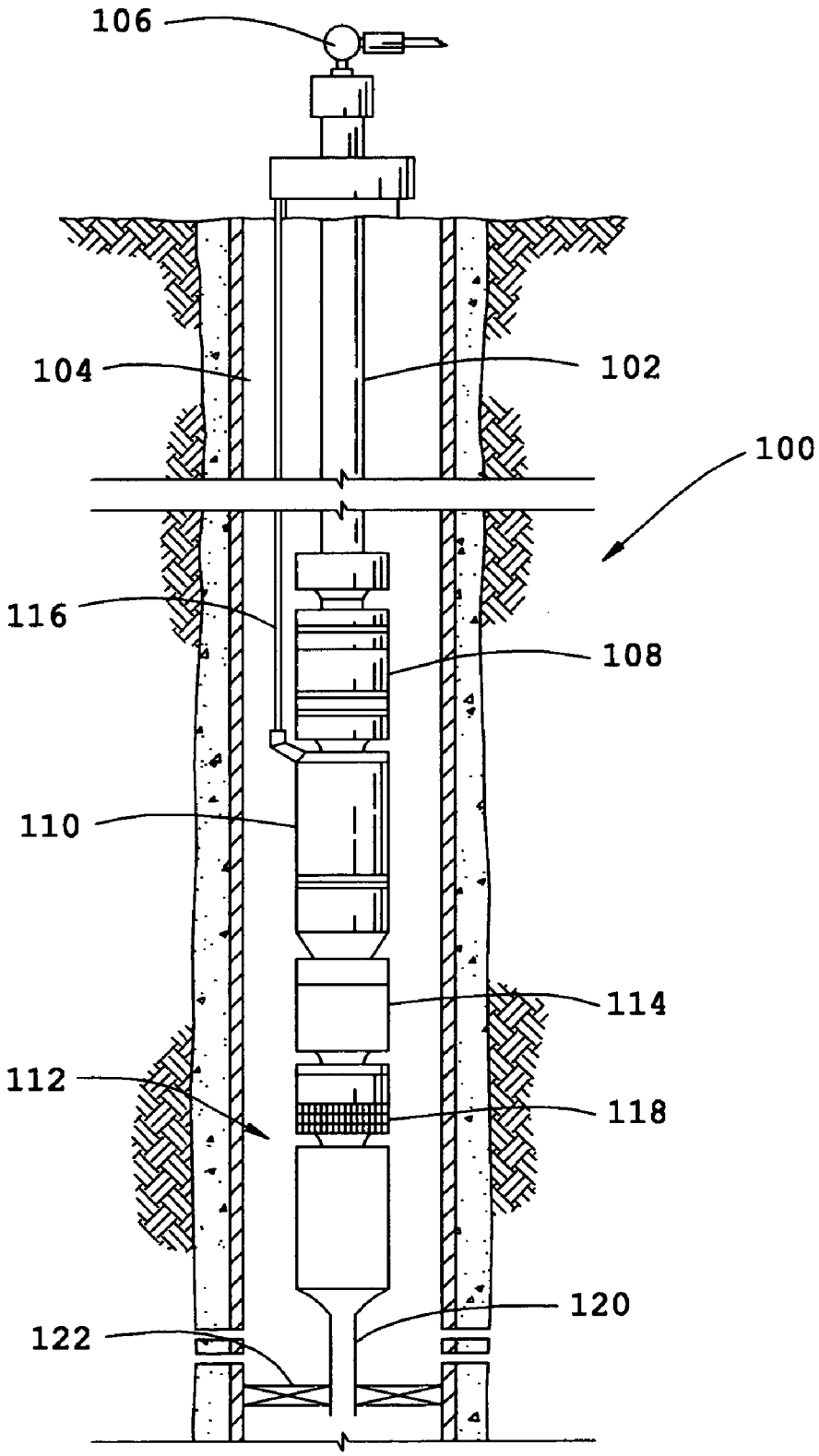
FIG. 2 is an elevational view of an electric submersible pumping system disposed in a wellbore constructed in accordance with a preferred embodiment of the present invention.

In accordance with a preferred embodiment of the present invention, FIG. 2 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface.

The pumping system 100 preferably includes an upper seal section 108, a motor assembly 110, a pump assembly 112, and a lower seal section 114. The seal section 108 shields the motor assembly 110 from axial thrust loading produced by the pump assembly 112 and ingress of fluids produced by the well. The seal section 108 also affords protection to the motor assembly 110 from expansion and contraction of motor lubricant. The motor assembly 110 is provided with power from the surface by a power cable 116.

Although only one pump assembly 112 and only one motor assembly 110 are shown, it will be understood that more than one of each can be connected when appropriate. The pump assembly 112 is preferably fitted with an intake section 118 to allow wellbore fluids from the wellbore 104 to enter the pump assembly 112, where the wellbore fluid is forced to a lower zone through tail pipe 120. An optional packer 122 can be used to separate wellbore fluids between adjacent well zones.

Figure 3:
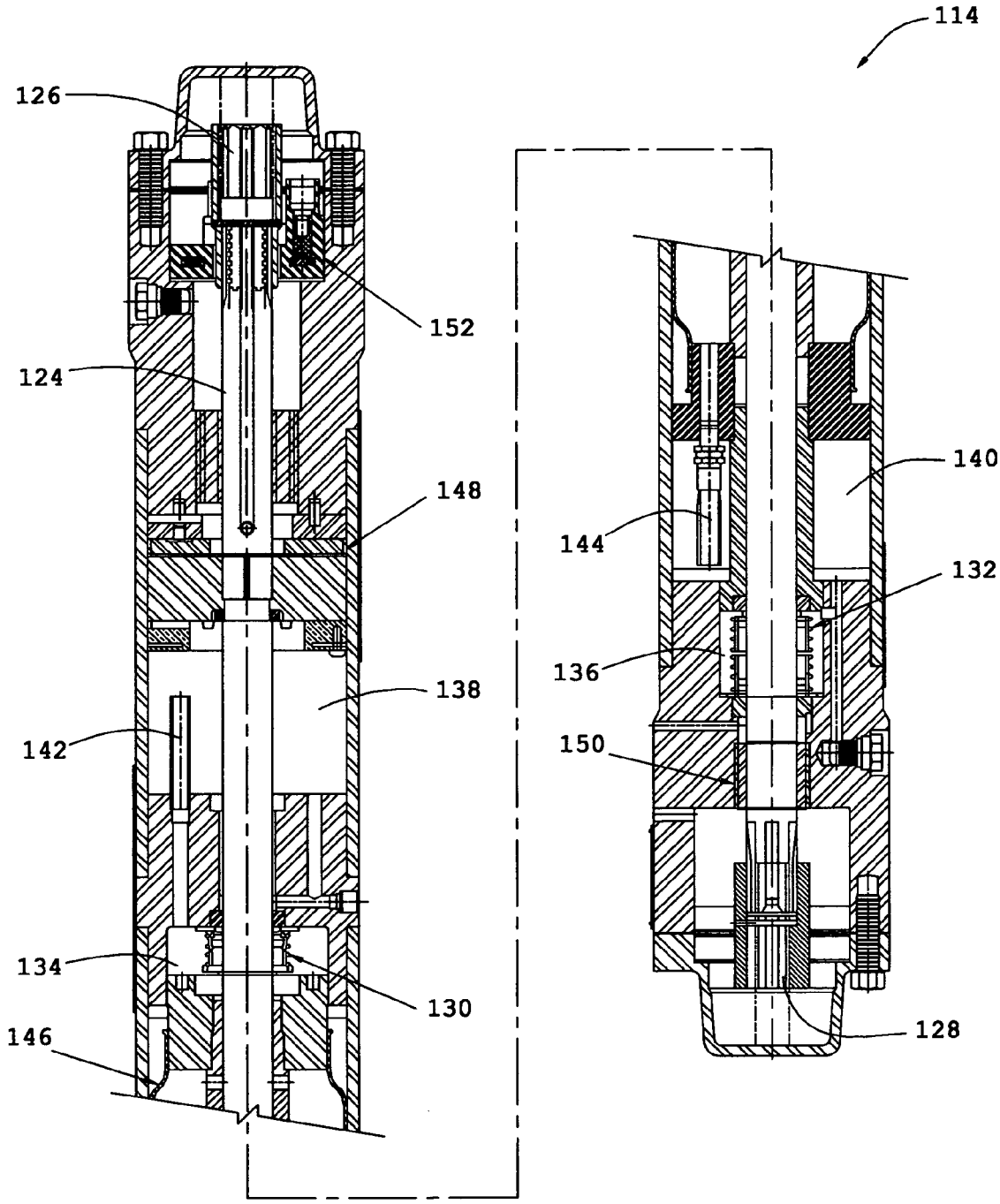
FIG. 3 is an elevational cross-sectional view of a seal section of the electric submersible pumping system of FIG. 2.

Referring now to FIG. 3, shown therein is an elevational cross-sectional view of a preferred embodiment of lower seal section 114. Filled with lubricating oil or other protective lubricant, the lower seal section 114 is substantially sealed from wellbore fluids and transmits torque from the motor assembly 110 to the pump assembly 112 via shaft 124. The lower seal section 114 is connected to the motor assembly 110 and the pump assembly 112 with motor coupling 126 and pump coupling 128, respectively. The lower seal section 114 is designed to protect the motor assembly 110 from axial shock created by the pump assembly 112. The lower seal section 114 also limits the ingress of wellbore fluids from the pump assembly 112 to the motor assembly 110.

In a preferred embodiment, mechanical seals 130, 132 are placed at strategic locations along the shaft 124 to prevent the migration of wellbore fluids through the seal section 114. The single and double mechanical seals 130, 132 restrict the flow of wellbore fluids along the shaft 124. If wellbore fluid migrates around the single and double mechanical seals 130, 132, the wellbore fluid is collected in chambers 134 and 136, respectively. Although the seal section 114 can adequately hinder the flow of wellbore fluids without the use of mechanical seals, a preferred embodiment employing the mechanical seals 130, 132 enhances the capability of the seal section 114.

To provide extra protection against the migration of wellbore fluid toward the motor assembly 110, a preferred embodiment of the present invention also employs labyrinth chambers 138, 140, which include labyrinth tubes 142, 144, respectively. Differences in the specific gravities of the wellbore fluid and the lubricant retard the movement of the wellbore fluid through the labyrinth chambers 138, 140, and ultimately toward the motor assembly 110.

Figure 4:
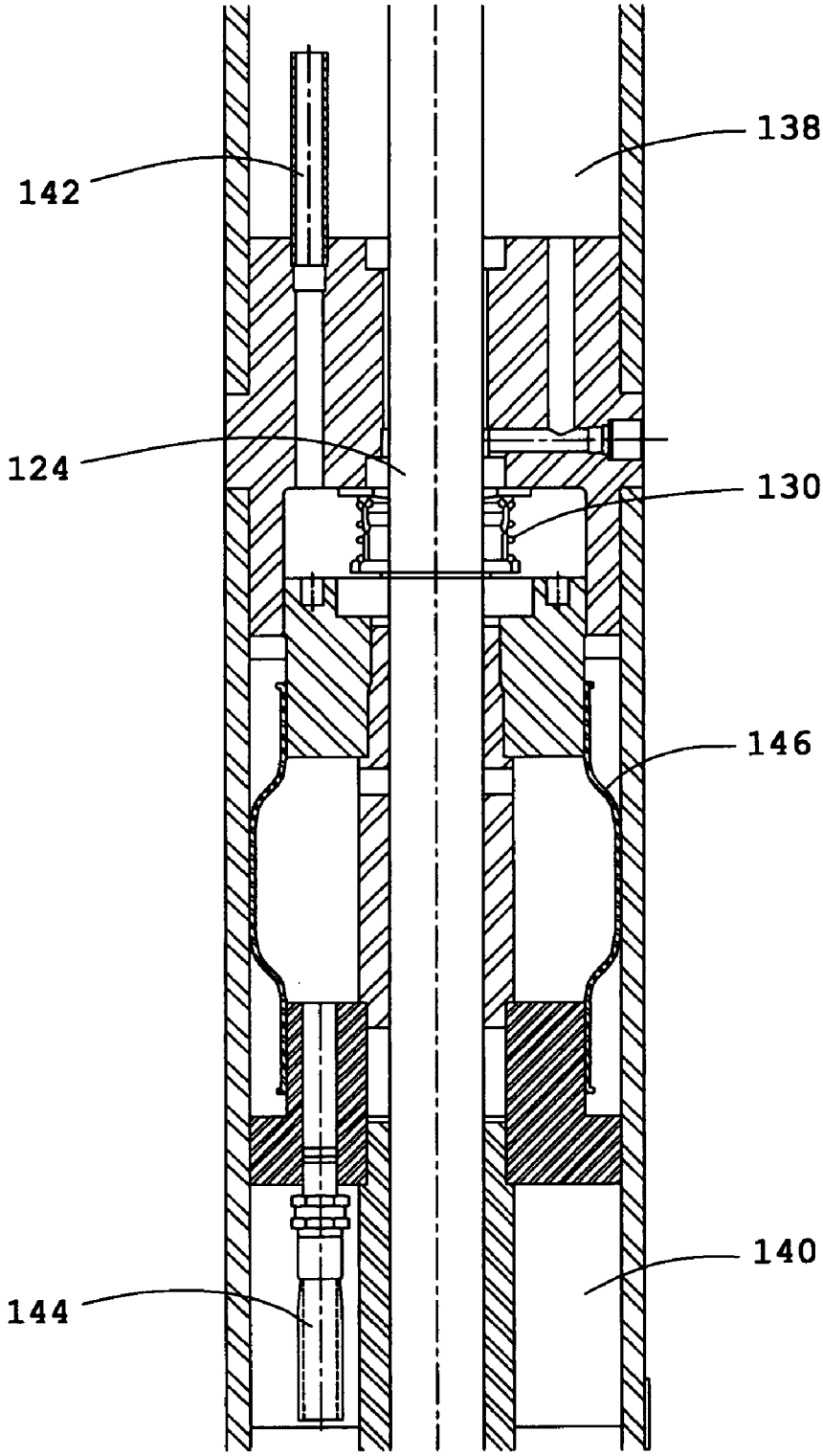
FIG. 4 is another elevational cross-sectional view of a seal section of the electric submersible pumping system of FIG. 2.

In another preferred embodiment, a protective expansion bag 146 can be used to provide a positive barrier between lubricant and wellbore fluid. Expansion and contraction of fluids in the seal section 114 due to pressure and heat variations can be accommodated by the expansion bag 146 as lubricant and wellbore fluids migrate through the seal section 114. The expansion bag 146 is more clearly shown in FIG. 4 without the expanded view lines of FIG. 3.

Axial thrust created by the pump assembly 112 (or alternatively by a separation device, not shown) is potentially damaging to the motor assembly 110. The seal section 114 absorbs much of the shock created by the axial thrust so that the motor assembly 110 is subjected to less thrust. Referring again to FIG. 3, in another preferred embodiment, a thrust bearing 148 absorbs axial thrust and protects internal surfaces of the seal section 114 that come in contact with the thrust bearing 148.

Abrasive substances present in wellbore fluids are harmful to the seal section 114, as well as the motor assembly 110. Spinning parts are especially susceptible to damage due the repetitive wear realized by adjacent moving parts. In another preferred embodiment, an abrasion resistant bearing 150 is utilized at the base of the seal section 114. Constructing the abrasion resistant bearing 150 with a hard, durable substance such as tungsten carbide slows the wear associated with abrasive substances in the wellbore fluid.

Typical submersible motors (such as 110) employ three-phase power using one of several wiring configurations known in the art, such as a wye or delta configuration. Termination of the wiring connection can be accomplished at the motor assembly 110, or alternatively in the seal section 114. In another preferred embodiment, a wye point connection 152 resides in the seal section 114 near the interface with the motor assembly 110. The wye point connection 152 completes the electric circuit for driving the motor assembly 110 when the seal section 114 is attached to the motor assembly 110, thereby providing the desired termination. The wye point connection 152 can be adapted to provide a termination for any desired wiring configuration used for powering the motor assembly 110.

In accordance with one aspect of a preferred embodiment, the present invention provides an apparatus for protecting an electric submersible motor, thereby increasing the motor's operating life. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An electric submersible pumping system for use in wellbore fluids, comprising:

a motor assembly having lubricating oil;

an upper seal section above the motor assembly that accommodates the expansion of the lubricating oil from the motor assembly;

a pump assembly below the motor assembly; and a lower seal section between the motor assembly and the pump assembly, wherein the lower seal section comprises:

a shaft that transmits torque from the motor assembly to the pump assembly; and a labyrinth chamber that restricts the migration of the wellbore fluids from the pump assembly to the motor assembly.

2. The electric submersible pumping system of claim 1, wherein the lower seal section does not accommodate the expansion of lubricating oil from the motor assembly.

3. The electric submersible pumping system of claim 1, wherein the lower seal section further comprises a mechanical seal that restricts the flow of the wellbore fluids.

4. The electric submersible pumping system of claim 1, wherein the lower seal section is filled with the lubricating oil and substantially sealed from the wellbore fluids.

5. The electric submersible pumping system of claim 4, wherein the lower seal section further comprises an expansion bag that provides a barrier between the lubricating oil in the lower seal section and the wellbore fluids.

6. The electric submersible pumping system of claim 5, wherein the wellbore fluids are restricted to the outside of the expansion bag.

7. The electric submersible pumping system of claim 1, wherein the lower seal section further comprises an abrasion resistant bearing to protect the shaft.

8. The electric submersible pumping system of claim 1, wherein the lower seal section further comprises a thrust bearing configured to withstand axial thrust generated by the pump assembly.

9. The electric submersible pumping system of claim 1, further comprising a packer that separates zones in the wellbore.

* * * * *